US005294939A

United States Patent [19]

Sanford et al.

[11] Patent Number: 5,294,939

[45] Date of Patent: * Mar. 15, 1994

[54] ELECTRONICALLY RECONFIGURABLE ANTENNA

[75] Inventors: Gary G. Sanford; Patrick M. Westfeldt, Jr., both of Boulder, Colo.

[73] Assignee: Ball Corporation, Muncie, Ind.

[ * ] Notice: The portion of the term of this patent subsequent to Sep. 26, 2010 has been disclaimed.

[21] Appl. No.: 2,692

[22] Filed: Jan. 11, 1993

Related U.S. Application Data

[63] Continuation of Ser. No. 730,334, Jul. 15, 1991, abandoned.

[51] Int. Cl.[5] ..... H01Q 3/240; H01Q 3/300; H01Q 1/380

[52] U.S. Cl. ..... 343/836; 343/853; 343/876

[58] Field of Search ..... 343/700 MS File, 815, 343/817, 818, 819, 876, 833-837, 853, 844, 893, 705, 708; H01Q 19/28, 19/29, 19/30, 19/31, 19/32, 21/00, 23/00, 25/00, 3/24, 3/25, 3/26, 3/27, 3/28, 3/29, 3/30

[56] References Cited

U.S. PATENT DOCUMENTS

| | | | |
|---|---|---|---|
| 3,096,520 | 7/1963 | Ehrenspeck | 343/834 |
| 3,109,175 | 10/1963 | Lloyd | 343/761 |
| 3,218,645 | 11/1965 | Ehrenspeck | 343/819 |
| 3,255,450 | 6/1966 | Butler | 343/853 |
| 3,307,188 | 2/1967 | Marchetti et al. | 343/797 |
| 3,495,263 | 2/1970 | Amitay et al. | 343/777 |
| 3,508,278 | 4/1970 | Ehrenspeck | 343/819 |
| 3,560,978 | 2/1971 | Himmel et al. | 343/837 |
| 3,611,401 | 10/1971 | Connolly | 343/854 |
| 3,858,221 | 12/1974 | Harrison et al. | 343/815 |
| 3,877,014 | 4/1975 | Mailloux | 343/833 |
| 3,883,875 | 5/1975 | McClymont et al. | 343/876 |
| 4,052,723 | 10/1977 | Miller | 342/368 |
| 4,053,895 | 10/1977 | Malagisi | 343/700 MS |
| 4,090,203 | 5/1978 | Duncan | 343/753 |
| 4,260,994 | 4/1981 | Parker | 342/368 |
| 4,321,605 | 3/1982 | Lopez | 343/844 |
| 4,360,813 | 11/1982 | Fitzsimmons | 343/770 |
| 4,631,546 | 12/1986 | Dumas et al. | 343/833 |
| 4,700,197 | 10/1987 | Milne | 343/837 |
| 4,797,682 | 1/1989 | Kimczak | 343/844 |
| 4,849,763 | 7/1989 | DuFort | 342/372 |
| 5,019,829 | 5/1991 | Heckman et al. | 343/705 |

FOREIGN PATENT DOCUMENTS

| | | | |
|---|---|---|---|
| 2602614 | 2/1988 | France | H01Q 3/24 |
| 0056703 | 4/1980 | Japan | 343/834 |
| 0088603 | 5/1986 | Japan | 343/853 |
| 0156706 | 6/1990 | Japan | H01Q 3/30 |

OTHER PUBLICATIONS

Translation of French Patent Application #2,602,614 to Jolly et al., Feb. 1988, 19 pp 343/836.

"Reactively Controlled Directive Arrays", *IEEE Transactions on Antennas and Propagation*, vol. A-26, No. 3, pp. 390-395, May, 1978, Roger F. Harrington.

*Primary Examiner*—Rolf Hille
*Assistant Examiner*—Peter T. Brown
*Attorney, Agent, or Firm*—Gilbert E. Alberding

[57] ABSTRACT

An electronically reconfigurable antenna includes individual antenna elements which can be reconfigured as active or parasitic elements in the process of variable mode operation. In the antenna, an active subset of antenna elements excites a wave on a parasitic subset of antenna elements, which are controlled by a plurality of electronically variable reactances.

The plurality of electronically variable reactances is used to provide the reconfigurable array, which may operate in a plurality of modes of wave propagation. Furthermore, the plurality of variable reactances allow compensation for the inherently narrow operating bandwidth of the high-gain surface wave antennas.

13 Claims, 8 Drawing Sheets

ELECTRONICALLY RECONFIGURABLE ANTENNA

This application is a continuation of application Ser. No. 07/730,334, filed Jul. 15, 1991 and now abandoned.

FIELD OF THE INVENTION

This invention relates to multiple element antenna arrays capable of operation in plural wave propagation modes, and more particularly relates to electronically reconfigurable array antennas comprising a plurality of active and parasitic antenna elements.

BACKGROUND OF THE INVENTION

A number of prior patents disclose antennas capable of operation to provide varying electromagnetic wave propagation.

U.S. Pat. No. 3,560,978 discloses an electronically controlled antenna system comprising a monopole radiator surrounded by two or more concentric circular arrays of parasitic elements which are selectively operated by digitally controlled switching diodes. In the antenna system of U.S. Pat. No. 3,560,978, recirculating shift registers are used to inhibit the parasitic elements in the circular arrays to produce the desired rotating wave pattern.

U.S. Pat. No. 3,877,014 relates to an electronically scanned, multiple element antenna array in combination with means for changing its operation between a multiple element array and an end-fire mode of operation. In the antenna of U.S. Pat. No. 3,877,014, a transmitter is switched to feed either a column array of antenna elements or the end-fire feed element. During end-fire operation, the column array of antenna elements are short circuited.

U.S. Pat. No. 3,883,875 discloses a linear array antenna adopted for commutation in a simulated Doppler ground beacon guidance system. In the end-fire commutated antenna array of U.S. Pat. No. 3,883,875, the linear array of n radiator elements is combined with a transmitting means for exciting each of the $n-1$ of said elements in turn, and an electronic or mechanical commutator providing for successive excitation in accordance with the predetermined program. Means are provided for short circuiting and open circuiting each of the $n-1$ elements, and the short circuiting and open circuiting means is operated in such a manner that during excitation of any one of said elements, the element adjacent to the rear of the excited elements operates as a reflector and the remaining $n-2$ elements remain open circuited and therefore electrically transparent. A permanently non-excited element is located at one end of the array.

In "Reactively Controlled Directive Arrays", *IEEE Transactions on Antennas and Propagation*, Vol. A-26, No. 3, May, 1978, Roger F. Harrington discloses that the radiation characteristics of an n-port antenna system can be controlled by impedance loading the ports and feeding only one or several of the ports. In Harrington's disclosed system, reactive loads can be used to resonate a real port current to give a radiation pattern of high directivity. As examples of the system, Harrington discloses a circular array antenna with six reactively loaded dipoles equally spaced on a circle about a central dipole which is fed, and a linear array of dipoles with all dipoles reactively loaded and one or more dipoles excited by a source. In operating the circular array antenna, Harrington discloses that by varying the reactive loads of the dipoles in the circular array, it is possible to change the direction of maximum gain of the antenna array about the central fed element and indicates that such reactively controlled antenna arrays should prove useful for directive arrays of restricted spatial extent.

U.S Pat. No. 4,631,546 discloses an antenna which has a transmission and reception pattern that can be electrically altered to provide directional signal patterns that can be electronically rotated. The antenna of U.S. Pat. No. 4,631,546 is disclosed as having a central driven antenna element and a plurality of surrounding parasitic elements combined with circuitry for modifying the basic omni-directional pattern of such an antenna arrangement to a directional pattern by normally capacitively coupling the parasitic elements to ground, but on a selective basis, changing some of the parasitic elements to be inductively coupled to ground so they act as reflectors and provide an eccentric signal radiation pattern. By cyclically altering the connection of various parasitic elements in their coupling to ground, a rotating directional signal is produced.

U.S. Pat. No. 4,700,197 discloses a small linearly polarized adaptive array antenna for communication systems. The antenna of U.S. Pat. No. 4,700,197 consists of a ground plane formed by an electrically conductive plate and a driven quarter wave monopole positioned centrally within and substantially perpendicular to the ground plane. The antenna further includes a plurality of coaxial parasitic elements, each of which is positioned substantially perpendicular to but electrically isolated from the ground plane and arranged in a plurality of concentric circles surrounding the central driven monopole. The surrounding coaxial parasitic elements are connected to the ground plane by pin diodes or other switching means and are selectively connectable to the ground plane to alter the directivity of the antenna beam, both in the azimuth and elevation planes.

U.S. Pat. No. 3,109,175 discloses an antenna system to provide a rotating unidirectional electromagnetic wave. In the antenna system of U.S. Pat. No. 3,109,175, an active antenna element is mounted on a stationary ground plane and a plurality of parasitic antenna elements are spaced along a plurality of radii extending outwardly from the central active antenna element to provide a plurality of radially extending directive arrays. A pair of parasitic elements are mounted on a rotating ring, which is located between the central active antenna element and the radially extending active arrays of parasitic elements and rotated to provide an antenna system with a plurality of high gain radially extending lobes.

In addition, U.S. Pat. Nos. 3,096,520, 3,218,645, and 3,508,278 disclose antenna systems comprising end-fire arrays.

Antenna systems including multiple active antenna elements with phasing electronics and/or phased transmitters are disclosed, for example, in U.S. Pat. Nos. 3,255,450, 3,307,188, 3,495,263, 3,611,401, 4,090,203, 4,360,813 and 4,849,763.

Antennas comprising a plurality of antenna elements in a planar array are also known. For example, U.S. Pat. No. 4,797,682 discloses a phased array antenna structure including a plurality of radiating elements arranged in concentric rings. In the antenna of U.S. Pat. No. 4,797,682, the radiating elements of each concentric ring are of the same size, but the radiating elements of different rings are different sizes. By varying the size of the radiating elements, the position of the elements will not be periodic and the spacing between adjacent rings will not be equal. Thus, grating lobes are minimized so they cannot accumulate in a periodic manner.

Notwithstanding this extensive developmental effort, problems still exist with multiple element antenna arrays, particularly with the performance of large apertures steered to end fire.

For a beam to be formed across the upper surface of an antenna array such as that shown in U.S. Pat. No. 4,797,682, each radiating element must be capable of delivering power across the face of the array, ultimately radiating along the ground plane and into free space at the horizon. In large antenna arrays consisting of a plurality of antenna elements and having diameters in excess of 10 wavelengths, the elements will receive much of this power, and act like a very glossy surface. In short, such large arrays tend to re-absorb a large portion of the power that is intended to be radiated. This effect is well known, and is often described in terms of mutual coupling effects, or active array reflection coefficient.

The plot in FIG. 1 describes one of the results of a 1983 Lincoln Labs study of phased arrays with wire monopole radiating elements. Gain-referenced patterns are plotted for a single central element embedded in many sizes of square arrays on an infinite ground plane. FIG. 1 indicates that the horizon gain of a single element falls drastically as the size of the array increases. For a 15-wavelength antenna, an element gain degradation of some 15.0 dB would be expected.

Similar results are obtained when comparing an isolated low-profile monopole, and the same element embedded in a 15 wavelength 1306-element circular array of identical low-profile monopoles. In this case, such antennas were mounted on a ground plane approximately 40 wavelengths in diameter. The maximum measured gain of the isolated element was approximately 5.15 dBil at 10° above the horizon. When embedded in the center of the 1306-element array, the element had measured gain of −11.1 dBil at 10° above the horizon, corresponding to 16.25 dB degradation.

Because not all elements are effected as severely as the ones measured in the center of such an array, it is difficult to make an array gain estimate. Furthermore, some degree of active matching is possible, which should marginally improve the gain. Even so, the end-fire gain of this large circular array will almost certainly not exceed 16.0 dBil, and may be as low as 13.0 dBil. Such gain is too low for the investment in apertures, and an intolerable thermal problem will result from more than 12.0 dB of RF power dissipation in the transmit mode.

STATEMENT OF THE INVENTION

This invention provides an electronically reconfigurable antenna in which individual antenna elements can be reconfigured as active or parasitic elements in the process of variable mode operation. In the antenna of this invention, an active subset of antenna elements excites a wave on a parasitic subset of antenna elements, which are controlled by electronically variable reactances to provide a non-complex and reliable, compact and lightweight, relatively inexpensive and efficient antenna system capable of operation in a plurality of modes of wave propagation.

In the invention, a plurality of electronically variable reactances is used to provide a reconfigurable array, which may operate in a plurality of modes of wave propagation. Furthermore, the plurality of variable reactances allow compensation for the inherently narrow operating bandwidth of the high-gain surface wave antennas.

This invention provides an electronically reconfigurable antenna including a plurality of antenna elements supported in an array adjacent and dielectrically isolated from a ground plane and adapted so that one or more of said antenna elements comprises active antenna elements driven from a source of electromagnetic energy and a plurality of the remainder of said antenna elements comprise antenna elements parasitically coupled to the one or more active antenna elements in said array. In the invention, a plurality of the remainder of said parasitic antenna elements are electrically connected to the adjacent ground plane by electronically variable reactances, which provide first reactances between the plurality of the remainder of the parasitic antenna elements to provide a first wave propagation characteristic of the antenna and second reactances between the plurality of the remainder of said parasitic antenna elements to provide a second wave propagation characteristic of the antenna.

In the invention, the plurality of antenna elements can form a linear, planar or curved surface array with the first reactances providing a first wave propagation characteristic and the second reactances providing a second wave propagation characteristic; the electronically variable reactances can comprise MMIC chips; and the plurality of active antenna elements can be driven from the source of electromagnetic energy through a plurality of phase shifters.

Other features and advantages of the invention will be apparent from the drawings and detailed description of he invention which follows.

BEST MODE OF THE INVENTION

Figure 1:
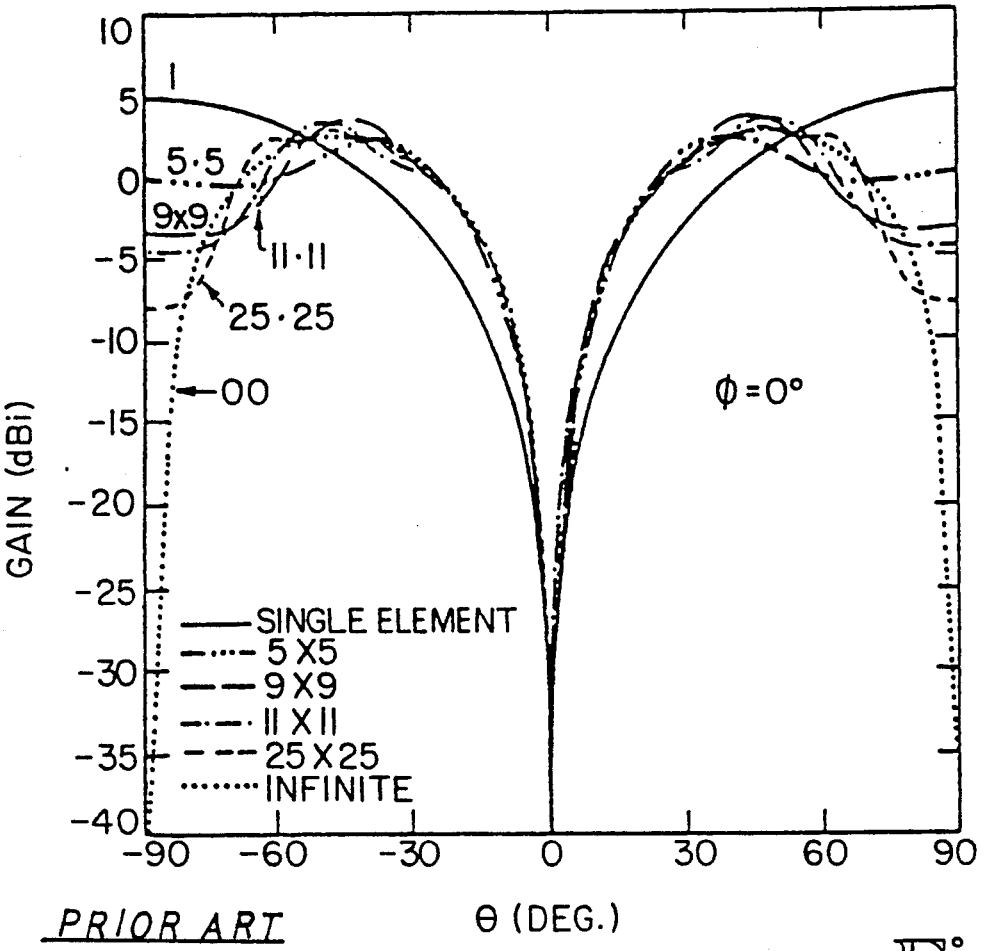
PRIOR ART Fig.1
FIG. 1 is a graphical prior art comparison of phased arrays demonstrating the gain degradation of a single element as the size of the array increases.
Figure 2:
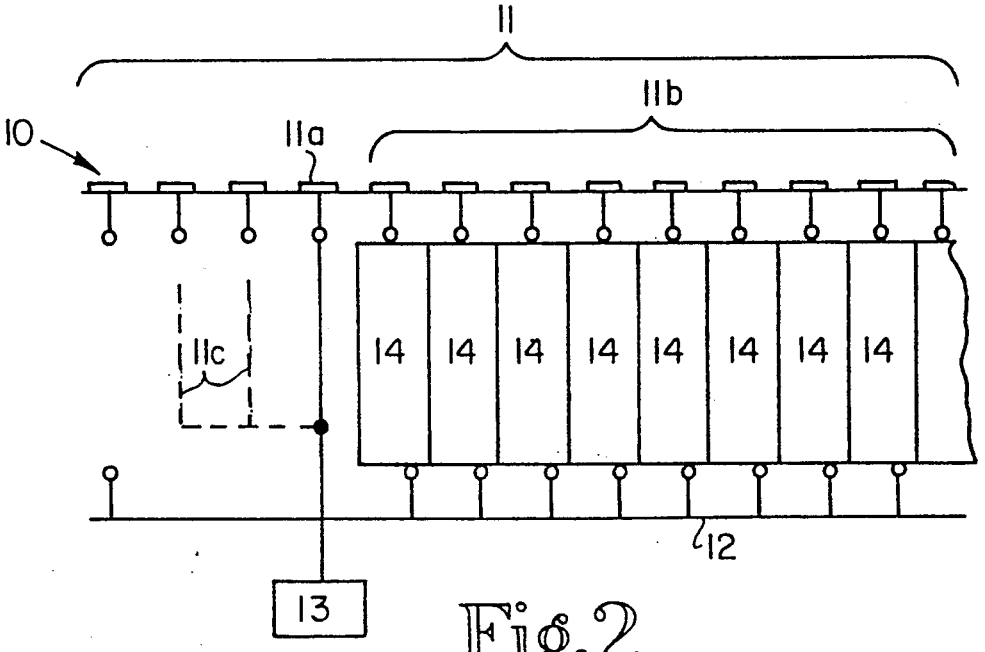
FIG. 2 is a diagrammatic illustration of the invention.

FIG. 2 is a diagrammatic illustration of an electronically reconfigurable antenna 10 of the invention. As shown in FIG. 2, a plurality of antenna elements 11 are supported in an array adjacent and dielectrically isolated from a ground plane 12. At least one of the antenna elements 11*a* comprises an active antenna element driven from a source of electromagnetic energy 13. A plurality of the remainder of the antenna elements 11*b* comprise antenna elements parasitically coupled to the at least one active antenna element 11*a* in said array. The plurality of antenna elements 11*b* of the remainder of antenna elements 11 are electrically connected to the adjacent ground plane 12 by electronically variable reactances 14. The electronically variable reactances 14 provide first reactances between ground and the antenna elements 11*b* of the plurality of the remainder of antenna elements to provide a first wave propagation characteristic of the antenna 10 and second reactances between ground and the antenna elements 11*b* of the plurality of the remainder of antenna elements to provide a second wave propagation characteristic of the antenna.

The first reactances of the electronically variable reactances 14 can be selected to provide a surface wave propagation characteristic and the second reactances can be selected to provide a leaky wave propagation characteristic.

As indicated in FIG. 2, in its simplest form, the plurality of antenna elements 11 can be supported in a linear array. Also, as indicated by phantom lines 11*c* in FIG. 2, a plurality of antenna elements can comprise active antenna elements driven from the source of electromagnetic energy 13. In addition, the plurality of active antenna elements can be driven from the source of electromagnetic energy 13 through a plurality of phase shifters.

Figure 3:
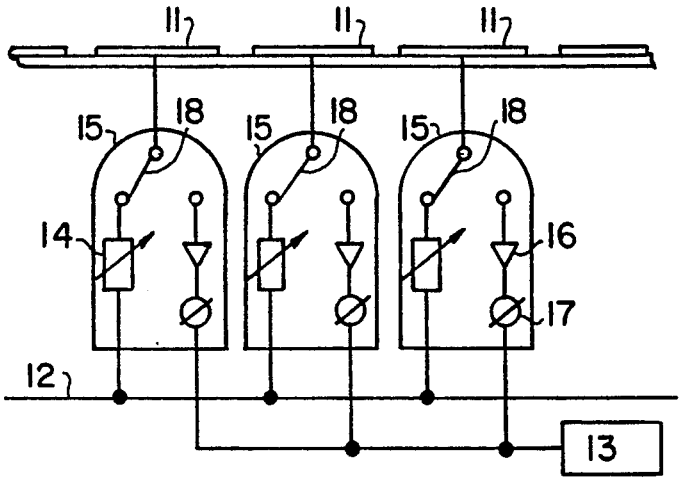
FIG. 3 is a diagram showing the manner of switching elements of antennas of the invention from active to parasitic modes of operation.

In preferred embodiments of the invention, each antenna element 11 can be connected to an MMIC chip or hybrid device 15 which, as shown in FIG. 3, can include the electronically variable reactance 14, and also an amplifier 16 and phase shifter 17, and electronically controlled switching element 18 to connect the antenna element to the ground plane 12 through electronically variable reactance 14 when the antenna element is to operate as a parasitic element and to connect the antenna element 11 through the amplifier 16 and phase shifter 17 to the source of electromagnetic energy 13 when the antenna element is to operate as an active antenna element. The electrical connections to operate the components of the MMIC chip 15 have been omitted from the drawings for clarity, but may be provided by appropriate electrical conductors, as known in the art.

Figure 4:
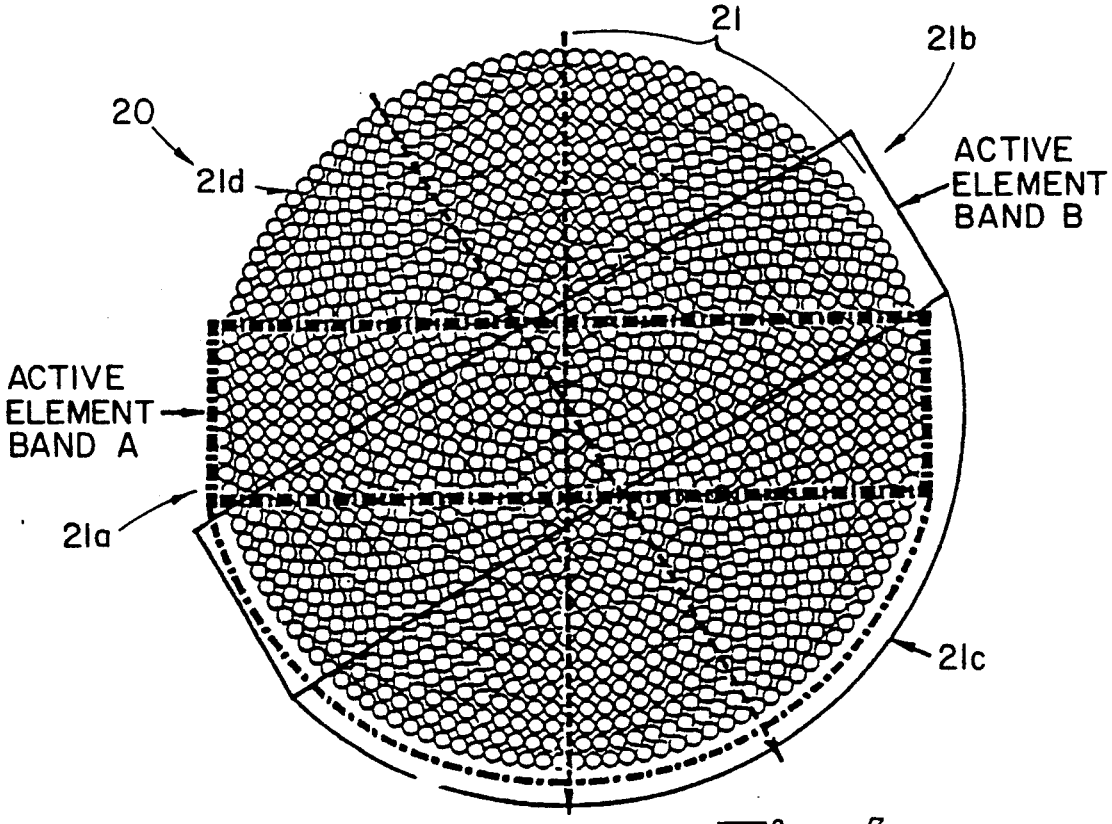
FIG. 4 is a diagrammatic plan view of a circular array antenna of the invention adapted to provide a plurality of active bands of elements to provide steerable horizontal wave propagation.

FIG. 4 shows an embodiment 20 of the invention in which a plurality of antenna elements 21 are formed in a circular array on a substantially planar dielectric surface. The circular planar array of antenna elements 21 may be formed from conductor-clad printed circuit board by etching away the conductor, as well known in the microstrip antenna art. In the antenna of the invention, the plurality of antenna elements 21 are connected, as described herein, to provide one or more active subsets of antenna elements and associated parasitic subsets of antenna elements. The antenna elements 21 of the circular array 20 may be provided with electronically variable reactances, as described above.

In the embodiment of the invention shown in FIG. 4, the circular array of antenna elements may provide operation much like a plurality of parallel Yagi-Uda arrays. The number of antenna elements is sufficient to form a plurality of active subsets of active antenna elements and associated subsets of parasitic antenna elements. Each of the plurality of active subsets form a band of active antenna elements like BAND A, containing active antenna elements 21*a*, and BAND B containing active antenna elements 21*b*. As shown in FIG. 4, BAND A and BAND B extend in different directions in the circular array.

For a given azimuth scan angle, a subset of the elements 21*a* in BAND A or 21*b* in BAND B, is selected as the active subset, analogous to the single element and reflector excitation of the Yagis. A large number of active elements may be used to distribute high transmit power, and so their excitation can be phased to optimize the launch efficiency of the surface wave. To maximize broadside launch directivity, each band of active elements (i.e., BAND A with elements 21*a*, BAND B with elements 21*b* . . . or BAND n with elements 21*n*) should have an extent equal to the array diameter. The antenna elements in front of an active subset in the direction of wave propagation, such as antenna elements 21*c* in front of BAND B, will be parasitic, loaded with a distribution of reactances that will maximize gain and control sidelobes in the pattern. Antenna elements to the rear of the active band, such as antenna elements 21*d* to the rear of BAND A, may be loaded to suppress backlobes. The antenna elements 21*c* and 21*d* are parasitic antenna elements forming a parasitic subset of parasitic antenna elements associated with the BAND B active antenna elements. As is readily apparent, associated parasitic subsets of antenna elements may be formed to the front and rear of the active antenna elements 21*a* of the BAND A subset.

To change the azimuth steering angle, a different active band (compare BAND A and BAND B of FIG. 4) is chosen, as well as a different distribution of parasitic reactances. FIG. 3 illustrates the circuit elements connected to the antenna elements to switch them between their active and passive roles. The variable reactance will have the same complexity as a 5-bit phase shifter with only one port. In antennas of the invention every element can be versatile, having a full T/R module along with the switching and variable reactance capability to become parasitic, but in many effective antennas of the invention, it is not necessary that every element have such capability and versatility.

Figure 5:
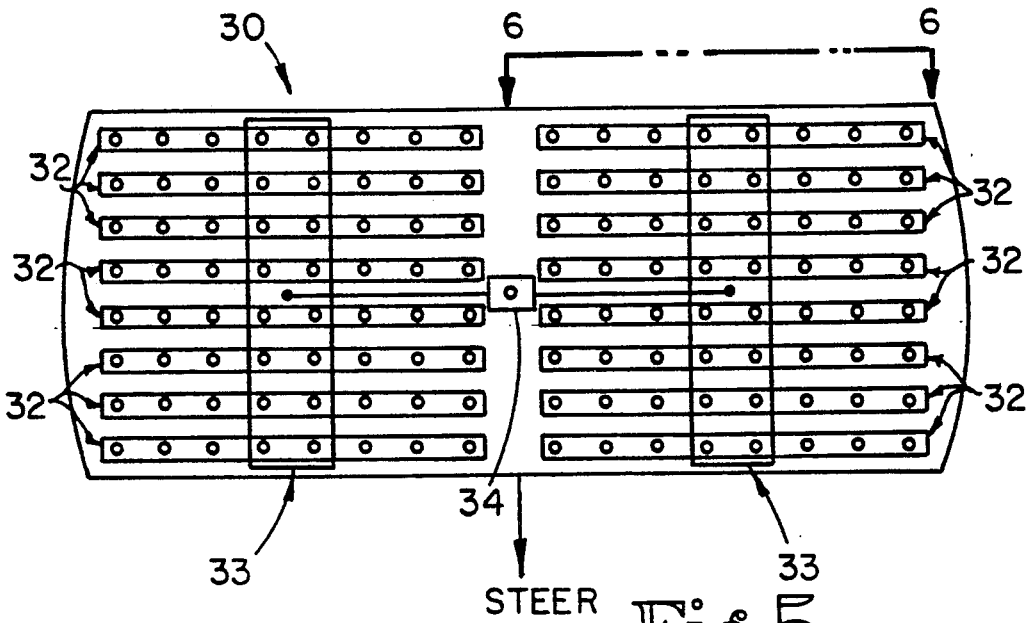
FIGS. 5 and 6 are diagrammatic illustrations of an antenna element feed system for an antenna, such as the antenna of FIG. 4, showing one manner in which electromagnetic energy can be distributed between and collected from the active antenna elements.
Figure 6:
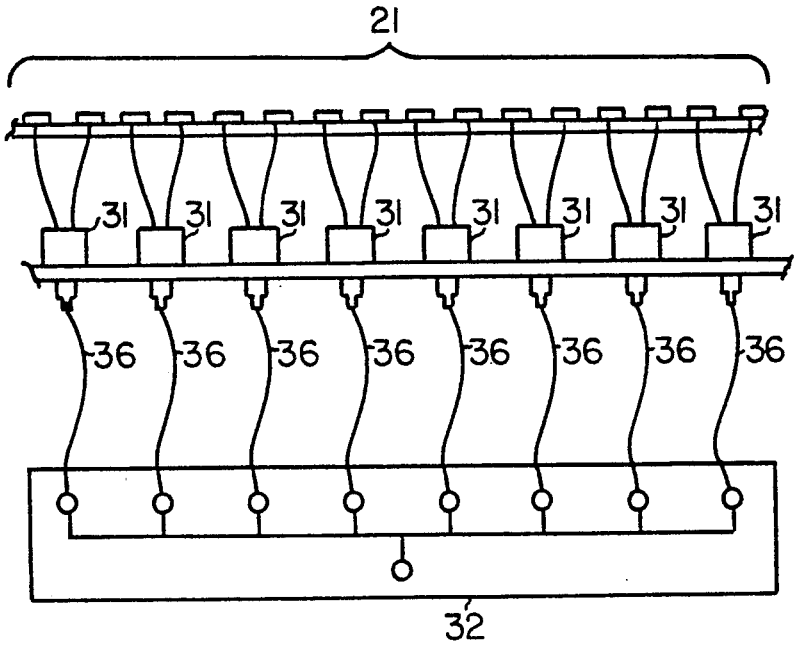

FIGS. 5 and 6 show, as well known in the art, how electromagnetic energy may be distributed and collected from the antenna elements. The antenna elements 21 can be organized in pairs, and connected with a compact two-way power divider/combiner 31 (FIG. 6), each with its own output connector. The phasing between the two antenna elements of each power combiner can follow normal geometric techniques for endfire steering. In order to arrive at the correct phasing relationships for the rest of the antenna element feed system, the far field phase at 10° elevation can be measured for all of the two-element arrays. This phase data can then be used for all phasing relationships in upper levels of the antenna element feed system.

The connector ports for the plurality of two-way power divider/combiners can be organized into groups of 8, then connected to 8-way power combiners with phase-compensated cables. FIG. 5 shows a schematic back view of an 128-way feed system 30, which includes 16 8-way power combiners 32, further combined by 2 8-way collectors 33 and finally by a 2-way combiner 34 at the input. Section 6—6 of FIG. 5 is shown in FIG. 6, with the connection of 8 2-element combiners 31 to one of the 16 8-way power combiners 32.

Any required phasing can be provided by varying the lengths of cables 36 to provide the measured phase differences. For the first level of 8-way power combiner, these differences can be small because the antenna elements 21 can be almost in a line orthogonal to the steering direction. The major phasing can be accomplished by the cables between the 8-way power combiners 32 and the 8-way collector boards 33, or by separate phase shifters.

As shown and described above, the invention provides an electronically reconfigurable antenna with an array of antenna elements having an extent of several wavelengths over an area, such as a circle, rectangle or other area useful in phased microwave arrays. The antenna elements (11, 21) of the array are sufficient in number to permit the formation of a subset of active antenna elements adapted to provide desired wave propagation characteristics such as beam width and direction, and to permit a subset of parasitic antenna elements adapted to assist the subset of active antenna elements in achieving desired wave propagation characteristics. The antennas can include an antenna element feed system providing a connection to each antenna element that can be electrically switched between an electronically variable reactance and a source and/or receiver of electromagnetic energy. The feed system can be controllable to provide connections between a plurality of antenna elements and the source/receiver of electromagnetic energy to form an active subset of antenna elements to provide the desired wave propagation characteristics of the antenna. The feed system can also be controllable to provide connections between a plurality of the remainder of the antenna elements and their associated electronically variable reactances in a subset of parasitic antenna elements that provide substantially lossless assistance in achieving the desired wave propagation characteristics of the antenna.

The invention can be used to provide antennas with a feed system that can be controlled to provide electronic scanning of the horizon, and surface wave enhancement. The feed system can also be controlled to vary the electronically variable reactances and/or the number and locations of the parasitic antenna elements in the parasitic subset of antenna elements to provide from the antenna both surface wave and leaky wave propagation for elevation scanning. Furthermore, the electronically variable reactances can allow compensation for the narrow operating bandwidth of such high gain antennas and provide an antenna capable of operating over a broader bandwidth than formerly possible.

Figure 7:
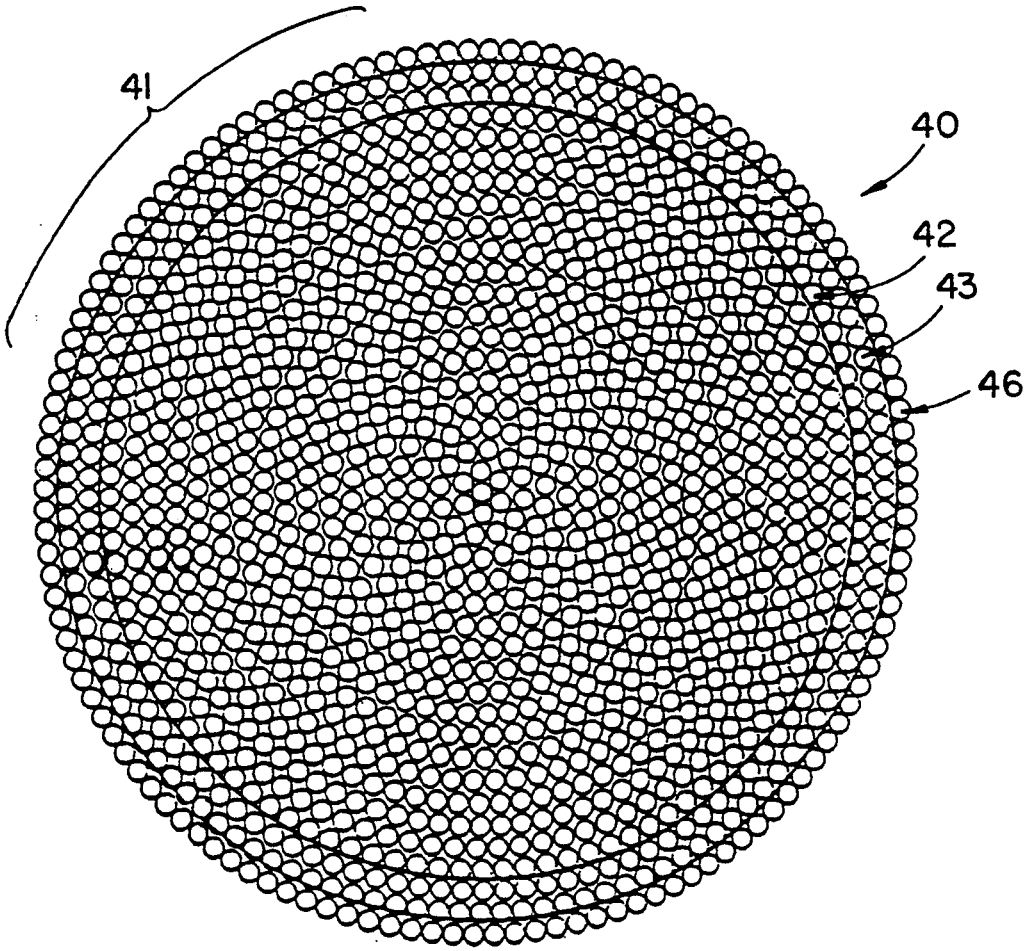
FIGS. 7 and 8 are diagrammatic plan views of a preferred circular phased array antenna using this invention.
Figure 8:
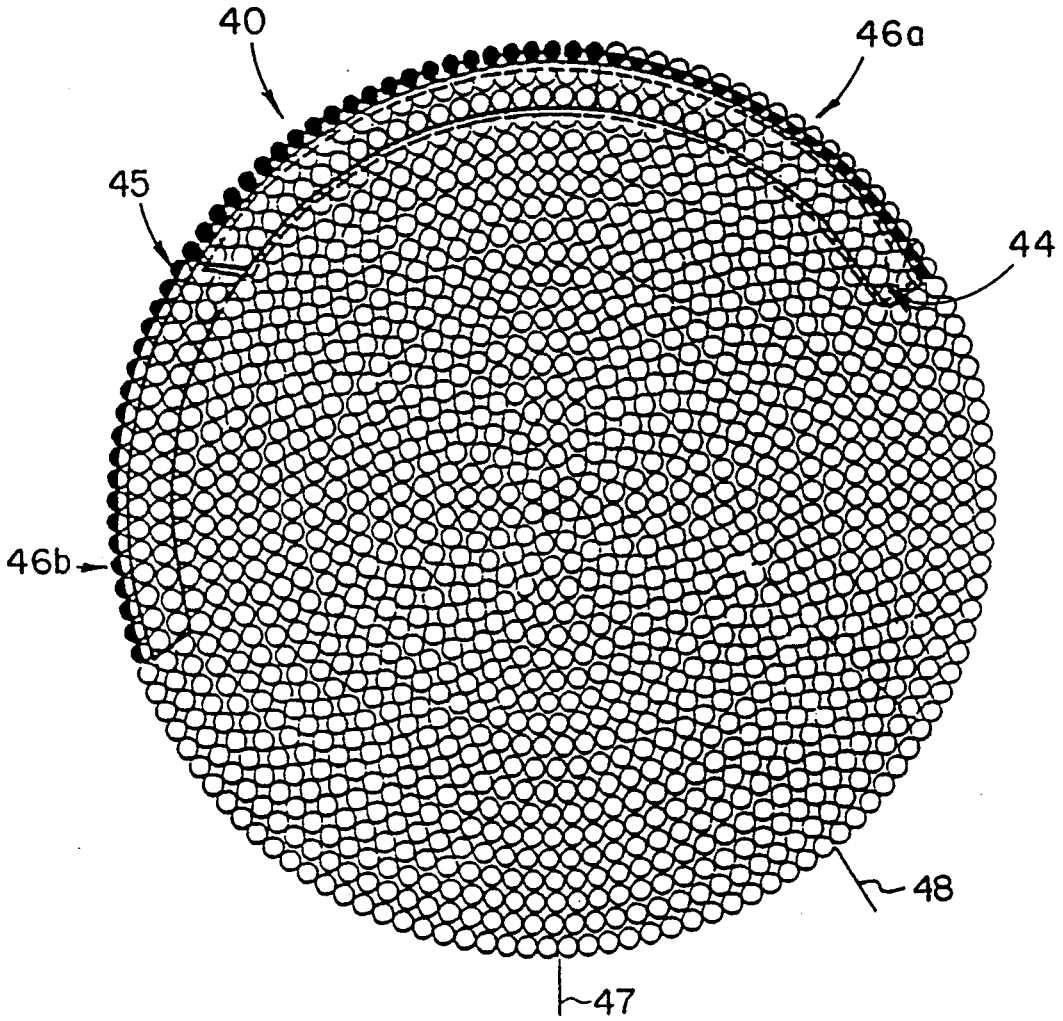

An antenna as shown in FIGS. 7 and 8 may provide a preferable mode of the invention and better results with an active band of lesser extent than the antenna shown in FIG. 4. The antenna surface is like the antenna surface of the antenna of FIG. 4, and it is supported adjacent a ground plane with an antenna element feed system including components like those described above, but connected and operated differently and more simply, as set forth below. As illustrated in FIG. 7, the antenna elements of only one or two outer rings 42, 43 (or at most, about 256 elements) need ever be active elements. The rest of the array (or about 1,050 antenna elements) can include only the electronically variable reactance, which can be a MMIC chip with very low weight and power requirement. Nor is it required that the parasitic surface be made up of the same antenna elements as the active elements, as long as the reactive surface formed by the subset of parasitic antenna elements can be varied electronically.

In the antenna 40 of FIGS. 7 and 8, the antenna elements included in the active subsets are selected in different sectors (44, 45 . . . ) of the two or more concentric rings 42, 43. As shown in FIG. 8, surface wave excitation may be enhanced by switchable reflector elements (46*a* in BAND A, 46*b* in BAND B) on the outermost concentric ring 46 of the array. The remainder of the elements of the array, as before, are loaded with a distribution of reactances to achieve the desired surface wave parameters. Scanning, or steering of the propagated wave is again accomplished by changing the position of active elements that make up the active subset sectors (44,45 . . . ) by locating them on different diameters (47,48 . . . ) aligned with the direction of beam steering (compare BAND A and BAND B). The parasitic element distribution may also be changed.

In this embodiment of the invention, the antenna elements of at least one of the outer concentric rings 42, 43 are adapted to be connected to a source of electromagnetic energy to provide one or more active antenna elements within a plurality of active subsets within different sectors, e.g., BAND A, BAND B, of at least one outer concentric ring 42, 43. A plurality of different sectors of active antenna elements are located about the outer concentric ring or rings 42, 43 on a plurality of diameters (e.g., 47, 48). The remaining antenna elements 41 of other concentric rings at least on or adjacent said plurality of diameters (e.g., 47, 48) are electrically connected to the adjacent ground plane by electronically variable reactances to provide selectably parasitic antenna elements on or adjacent the plurality of diameters. The active antenna elements and the parasitic antenna elements on or adjacent said plurality of diameters can provide surface wave propagation characteristics with first reactances of the electronically variable reactances and leaky wave propagation characteristics with second reactances of the electronically variable reactances and the plurality of antenna elements of the array can be controlled to electronically scan around the plane of the array, and, for example, the horizon. In preferred embodiments, at least one of said outer concentric rings 42, 43 of selectively active elements lies within the outermost concentric ring 46 of antenna elements, and the outermost of the outer concentric rings 46 is electrically connected to the adjacent ground plane by electronically variable reactances providing first and second reactances to reflect the electromagnetic wave propagated by the subset of active elements, e.g., BAND A and BAND B.

The antenna of FIGS. 7 and 8 may represent huge savings in weight, power requirement, complexity, reliability and cost, compared to the antenna of FIG. 4.

It is believed that the horizon gain of a 15 wavelengths circular phased array of this invention may be as high as 26 dBil.

Figure 9:
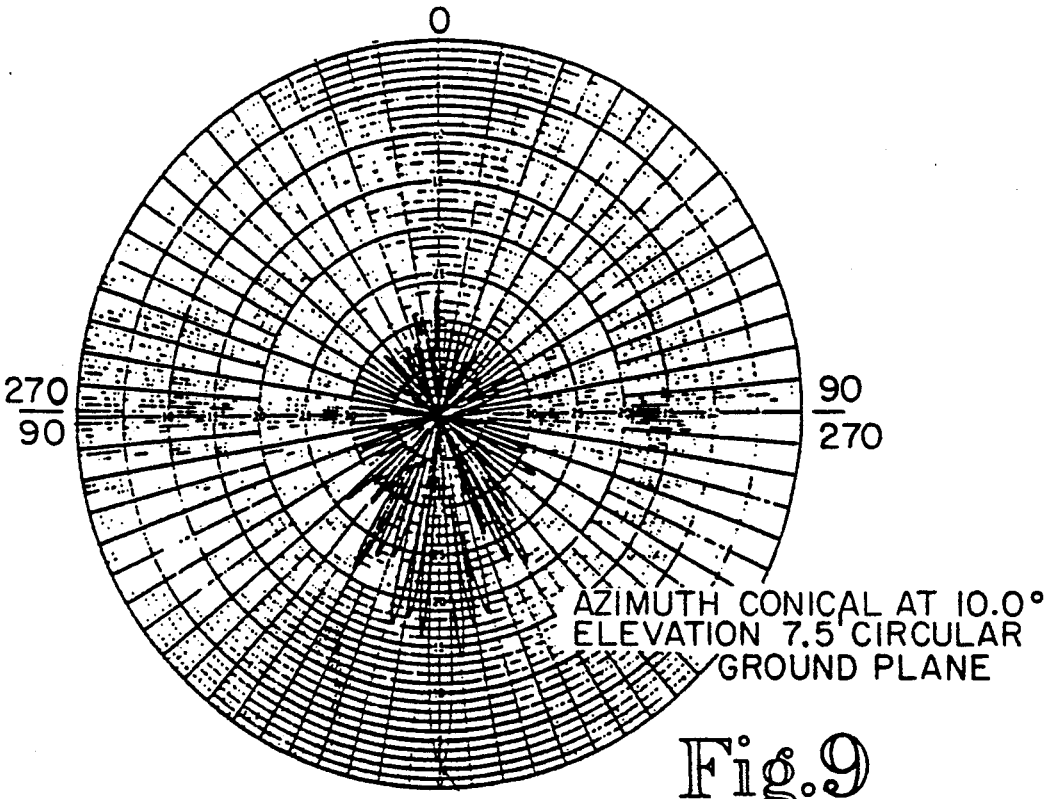
FIG. 9 is a measured radiation pattern of a circular phased array antenna of the invention with 64 active elements elements, demonstrating an azimuthal conical pattern at 10° elevation.
Figure 10:
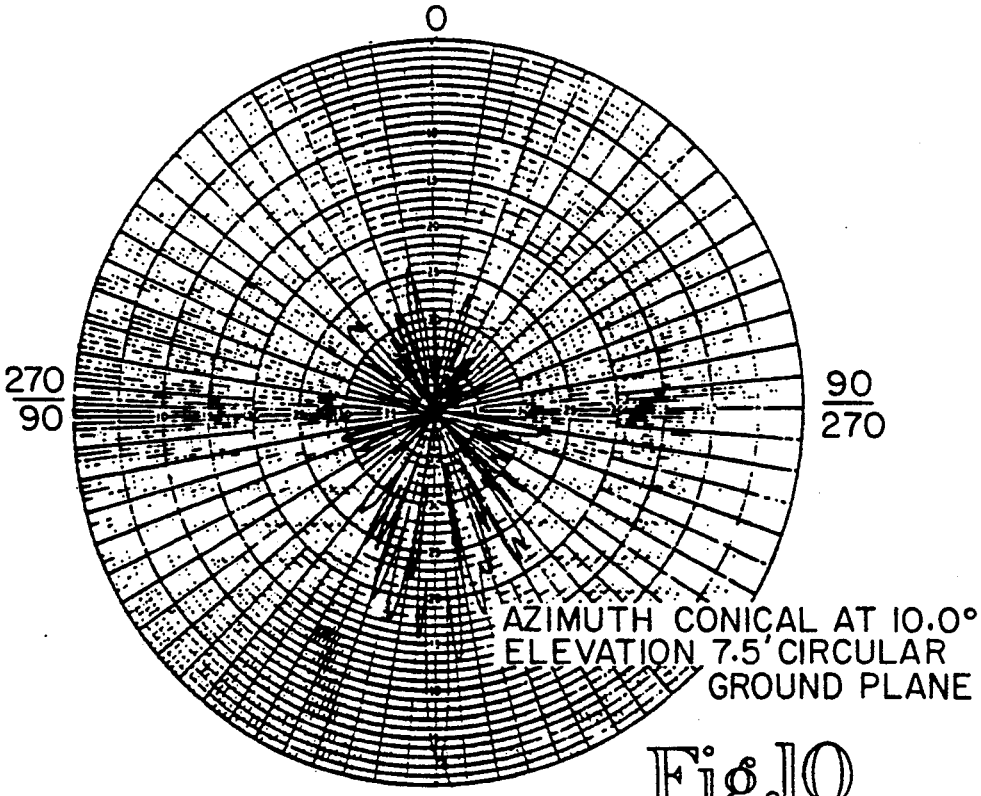
FIG. 10 is a measured radiation pattern of another circular phased array antenna of the invention with 128 active elements, demonstrating an azimuthal conical pattern at 10° elevation.

Measurements were made with a fixed-beam antenna of the invention, built in the form of FIG. 4 with center-bands of 64 and 128 active elements, mounted on a 7.5' ground plane, which results in the peak of an end-fire beam occurring at approximately 10° elevation. Both elevation and azimuthal conical cuts were taken, with the conical cuts taken through the peak of the elevation beam at 10°. FIGS. 9 and 10 present conical patterns for 64-element and 128-element active arrays of the invention at 4.8 GHz.

FIG. 9 is the 10° conical for the 64-element active band. As shown in FIG. 9, the beam is very well formed with sidelobes only slightly higher than would be expected for the uniform amplitude distribution used. The measured peak gain was 21.07 dBil, and the antenna suffered a loss of about 2.35 dB in the feed system. The aperture gain for this pattern was therefore about 23.45 dBil. Similarly, FIG. 10 is the 10° conical for the 128-element active band. In this case, the peak gain was 20.77 dBil with 2.65 dB loss in the feed system, yielding coincidentally the same aperture gain of 23.45 dBil. These aperture gains correspond favorably to ideal array values of about 26 dBil, if element efficiencies, element mismatches and mutual coupling losses are taken into account.

Figure 11:
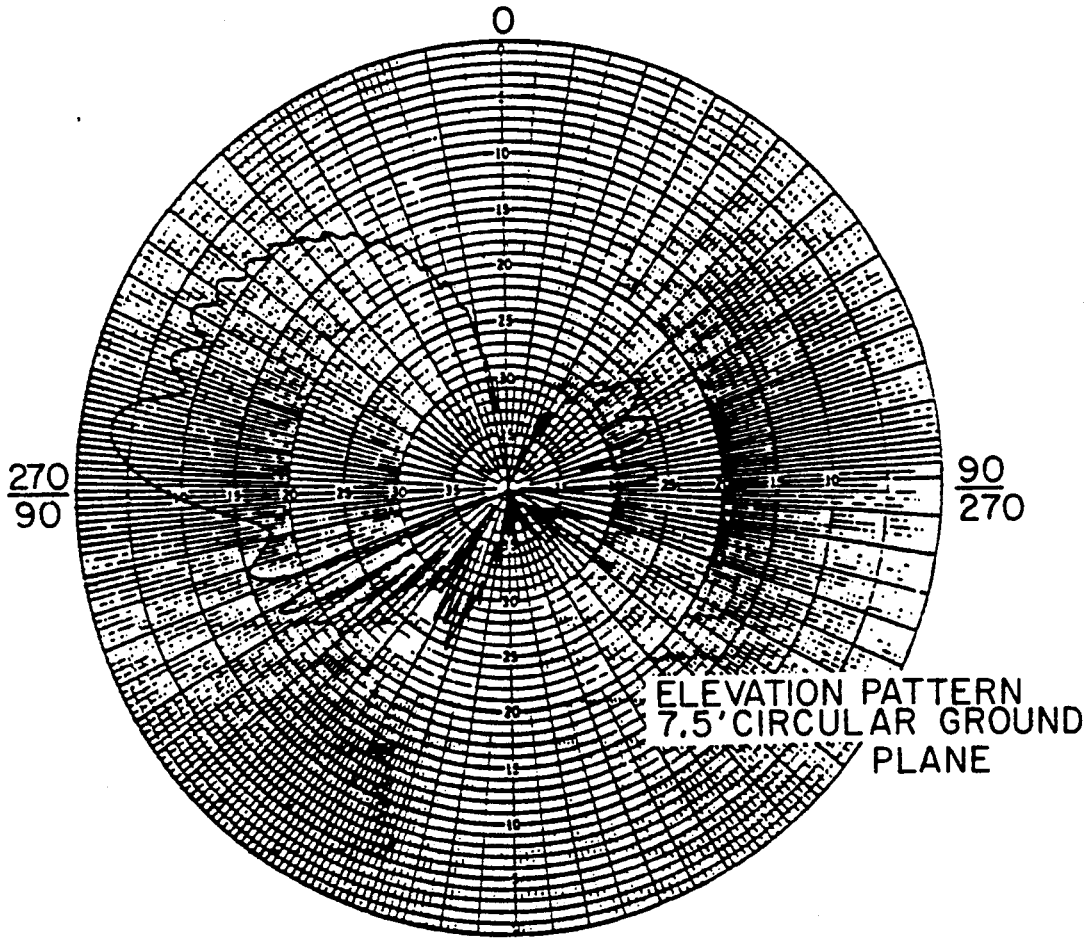
FIG. 11 is a measured radiation pattern of the circular phased array of FIG. 9, with 64 active elements, demonstrating an elevation pattern.
Figure 12:
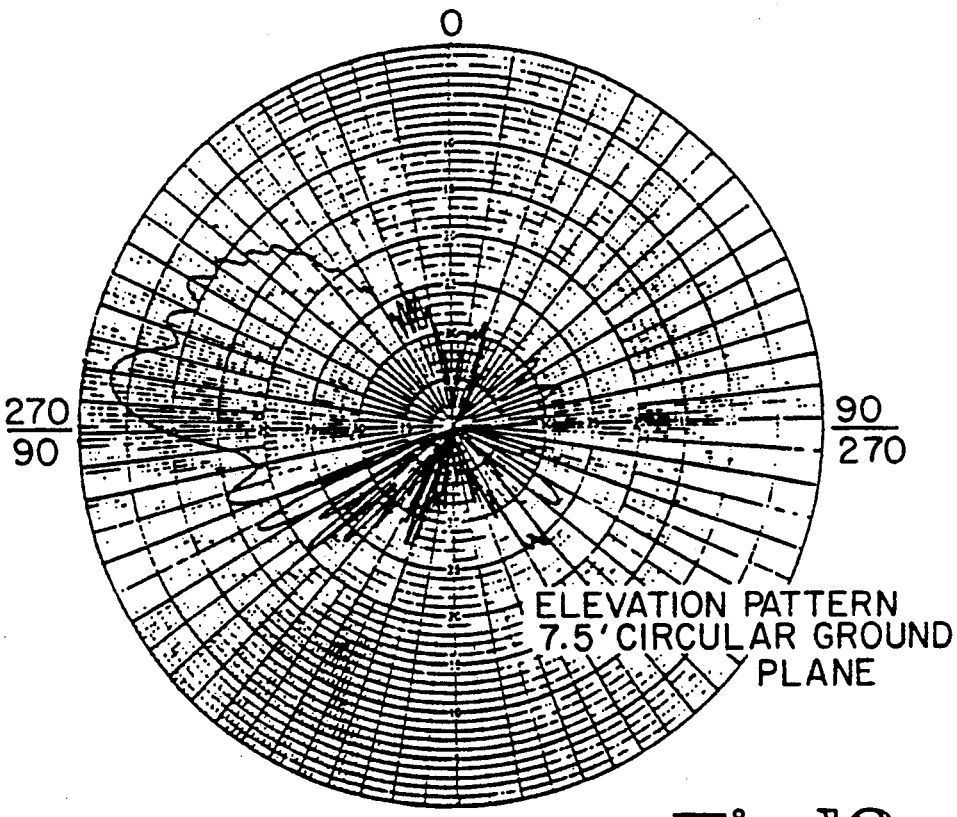
FIG. 12 is a measured radiation pattern of a circular phased array of FIG. 10, with 128 active elements, demonstrating an elevation pattern.

FIGS. 11 and 12 are the elevation patterns for the antennas with 64 elements and 128 elements, respectively. Both elevation patterns (FIGS. 11 and 12) have extremely high sidelobe levels, which represents the direct radiation (i.e., not coupled to the surface wave) of the active band arrays. The elevation beam of the 128-element antenna (FIG. 12) is considerably narrower than the elevation beam of the 64-element antenna (FIG. 11). This effect is easily explained by the higher directivity, and resulting surface wave launch efficiency, of 4 rows steered to end-fire (128-element active band) as opposed to 2 rows (64-element active band). The fact that the net aperture gain was almost the same in the two cases is a result of higher mutual coupling losses in the 128-element case, since the directivity must be higher.

The table I (below) summarizes the gain results at 4.8 GHz. A rough measurement of directivity was also made, in order to estimate the aperture efficiency, which would include element efficiency, element mismatch loss and mutual coupling loss. This measurement is the result of taking amplitude measurements over all space and performing the appropriate weighted summations. Some error is to be expected due to granularity in summing over the very narrow azimuth beam, and the directivity values obtained seem high compared to theoretical estimates in light of what appears to be non-optimum launch efficiency.

TABLE I

| | 64 ELEMENTS ACTIVE | 128 ELEMENTS ACTIVE |
|---|---|---|
| GAIN | 21.1 dBil | 20.8 dBil |
| FEED LOSS | 2.35 dB | 2.65 dB |
| APERTURE GAIN | 23.45 dBil | 23.45 dBil |
| DIRECTIVITY | 26.4 dBil | 27.1 dBil |
| APERTURE EFFICIENCY | 3.0 dB | 3.7 dB |

As shown above, the invention can provide an electronically reconfigurable antenna capable of plural wave propagation and a steerable high gain beam at very low angles to a planar aperture.

While certain and presently known preferred embodiments of the invention are illustrated and described above, it will be apparent to those skilled in the art that the invention may be incorporated into other embodiments and antenna systems within the scope of the invention as determined from the following claims.

What is claimed is:

1. An electronically reconfigurable antenna, comprising:

an array of a plurality of antenna elements extending several wavelengths over an area, the number of such antenna elements being sufficient to form a subset of active antenna elements and an associated subset of passive parasitic antenna elements; and an antenna element feed system providing connections to each one of said plurality of antenna elements that include connections to electronically variable reactances and connections to a source or receiver of electromagnetic energy, said feed system being controllable to provide connections between said subset of active antenna elements and said source or receiver of electromagnetic radiation providing wave propagation in one mode over the array and to provide connections between said associated subset of passive parasitic antenna elements and an adjacent ground plane through said electronically variable reactances to assist the propagation of the wave in said one mode from said subset of active antenna elements.

2. The antenna of claim 1 wherein said plurality of antenna elements are supported in a planar array.

3. The antenna of claim 1 wherein said electronically variable reactances are switchable between first reactances providing a surface wave propagation characteristic and second reactances providing a leaky wave propagation characteristic.

4. The antenna of claim 1 wherein said electronically variable reactances comprise MMIC chips.

5. The antenna of claim 1 wherein said active antenna elements in said active subset are arranged to provide a phased array.

6. The antenna of claim 5 wherein said active antenna elements are driven from said source of electromagnetic energy through a plurality of phase shifters.

7. An electronically reconfigurable antenna, comprising:

an array of a plurality of antenna elements extending several wavelengths over an area, the number of such antenna elements being sufficient to form a plurality of active subsets of active antenna elements and a plurality of associated passive subsets of passive parasitic antenna elements; and an antenna element feed system providing a connection to each one of said plurality of antenna elements that can be electrically switched between an electronically variable reactance and a source or receiver of electromagnetic energy, said feed system being controllable to provide connections between a first active subset of active antenna elements and said source or receiver of electromagnetic energy providing wave propagation in one mode over the array and to provide connections between said plurality of passive subsets of passive antenna elements and an adjacent ground plane through said electronically variable reactances to assist the wave propagation from said first subset of active antenna elements in said one mode.

8. The antenna of claim 7 wherein antenna elements that are not in each active subset are connected by said antenna feed system to said electronically variable reactances, and said electronically variable reactances are controllable to provide first reactances providing surface wave propagation as said one mode and second reactances providing leaky wave propagation as a second mode of operation.

9. The antenna of claim 7 wherein said electronically variable reactances comprise MMIC chips.

10. The antenna of claim 7 wherein said active antenna elements in at least one of the plurality of active subsets are arranged to provide a phased array.

11. The antenna of claim 10 wherein said active antenna elements in said at least one of the plurality of active subsets are connected to said source or receiver of electromagnetic energy through a plurality of phase shifters.

12. The antenna of claim 7 wherein said array of said plurality of antenna elements are arranged in a planar array.

13. The antenna of claim 7 wherein said array of said plurality of antenna elements are arranged in a curved surface array.

* * * * *